33-241 SR
6/11/85 XR 4,521,972

United States Patent [19]

Larson

[11] Patent Number: 4,521,972

[45] Date of Patent: Jun. 11, 1985

[54] ILLUMINATED SIGHTING STRUCTURE FOR ARCHERY BOWS

[76] Inventor: Marlow W. Larson, 2735 S. 4050 West, Ogden, Utah 84401

[21] Appl. No.: 489,499

[22] Filed: Apr. 28, 1983

[51] Int. Cl.[3] ..... F41G 1/34; F41G 1/46

[52] U.S. Cl. ..... 33/265; 33/241; 362/110

[58] Field of Search ..... 33/241, 265; 124/87; 200/51.14, 60, 158; 362/110, 204, 206

[56] References Cited

U.S. PATENT DOCUMENTS

| | | | |
|---|---|---|---|
| 807,993 | 12/1905 | Bassell et al. | 33/241 |
| 2,529,057 | 11/1950 | Teffault | 33/241 |
| 3,138,688 | 6/1964 | Kolm et al. | 200/158 |
| 3,450,122 | 6/1969 | Diamond | 33/265 |
| 3,481,658 | 12/1969 | Dietrich et al. | 33/241 |
| 3,945,127 | 3/1976 | Spencer | 33/265 |
| 4,195,414 | 4/1980 | Robinson | 33/265 |
| 4,220,983 | 9/1980 | Schroeder | 33/265 |
| 4,325,190 | 4/1982 | Duerst | 33/265 |
| 4,400,887 | 8/1983 | Mason | 33/265 |
| 4,417,299 | 11/1983 | Rupp | 362/206 |

*Primary Examiner*—Richard R. Stearns
*Attorney, Agent, or Firm*—M. Ralph Shaffer

[57] ABSTRACT

Illuminated sighting structure for archery bows wherein a bow attachment bracket is provided not only with sighting units but also with lighting means for selectively illuminating such sighting units, especially the tips thereof. The bow-sight illumination structure itself is designed to have a plastic non-conductive case and allowing for on-off conditions of the light employed by a non-conductive element being interposed in the electrical circuit, which, when compressed, will complete such circuit. This is preferably accomplished by a metallic disc or element within a non-conductive ring, the disc being of less width than the ring. An adjustment screw accomplishes the width-wise compression of the ring, for conduction purposes, and also a backing off such that the ring by its nature expands so as to separate the electrical elements of the lighting circuit.

9 Claims, 8 Drawing Figures

ILLUMINATED SIGHTING STRUCTURE FOR ARCHERY BOWS

This invention relates to illumination structures and, more particularly, to illuminate the sights of archery bows.

BRIEF DESCRIPTION OF PRIOR ART

In the past a number of lighting structures have been employed for both firearms and also archery bows, in the latter case to illuminate sights. The prior art with which the inventor is aware currently teaches the utilization of illumination structures having metal housings and which rely upon such metal housing for completing the electric circuit utilized. It is believed that some of these may have been patented even though the patent numbers are currently unknown.

Such sight illumination structures as have heretofore been devised of which the inventor is aware, have been very expensive to produce, and this largely because of the fact that the housings themselves are extremely expensive to machine or rather cumbersome to cast. It would be highly desirable, of course, for injection molding machines to be utilized such that plastic parts, of an essentially inherent non-conductive character, can be employed to house the electric circuit of the lighting structure. This drastically reduces expense in manufacture of the housing needed. However, when such a device is used, one must take care that the switching mechanism utilized will not be subject to malfunction during inclement weather, weather which archers frequently encounter in the outdoors, and also that the switching will be very, very inexpensive to manufacture and utilize, and yet have a high degree of reliability in operation. For this purpose the inventor has eliminated the customary button or other type of switch, but rather employs an adjustment screw which relies for its effect on a non-conductive ring or other element that can be compressed so as to effect a closure of the electrical circuit utilized. When a condition of the non-conduction is desired, and hence non-operation of the light utilized, the adjustment screw is simply backed off so as to allow the non-conductive compressive element to expand and thereby separate the otherwise electrically contacting units. Preferably, this ring is disposed between two battery elements, the conductive element utilized being a conductive metallic disc of less width than the rubber or elastomeric compressive ring utilized. Thus, in the normal condition the light of the circuit will be non-energized since the elastomeric ring will separate the batteries or other elements in the circuit. Where the adjustment screw is tightened down, however, then the batteries are brought in engagement with the reduced-thickness metallic disc, thereby completing the circuit and by this, compressing the rubber or elastomeric ring utilized between the batteries and disposed about such disc.

BRIEF DESCRIPTION OF THE INVENTION

Accordingly, the present invention utilizes a bracket which is attached to an archery bow, the bracket or mount incorporating several slots wherein various sighting element units can be placed and mounted. The sights themselves can be prior art as hereinafter explained. Attached to the bracket is also a lighting structure that can be turned on and off, which lighting structure is used to direct a beam of light upon at least the tips of the sighting units employed. The lighting structure utilizes an adjustment screw the operative end of which is disposed within the non-conductive case of the lighting unit. Such screw end is effective both to separate and also to render in contact certain electrical elements or portions of the electrical circuit used to energize the light. Elastomeric means is used and is both compressible and resilient so as to permit a joining of electrical elements through a tightening of the screw, and also a separation of such elements when the screw is backed off so as to allow the elastomeric structure such as the ring to separate electrical elements such as batteries utilized within the housing.

OBJECTS

Accordingly, a principal object of the present invention is to provide new and useful lighted sighting structures for archery bows.

An additional object is to provide a mount accommodating both sighting units and also a sight illumination structure for archery bows.

A further object is to provide for archery bows, and to illuminate the sights thereof, suitable illumination structure, the same relying upon an interior electrical circuit for rendering the light employed both conductive and non-conductive, selectively.

An additional object is to provide an illumination structure wherein the interior is provided with a non-conductive compressible resilient ring or other element, this useful in both separating electrical parts in the circuit employed and also when in an electrical-contact condition.

BRIEF DESCRIPTION OF DRAWINGS

The present invention may best be understood by reference to the following description, taken in connection with the accompanying drawings in which.

DETAILED DESCRIPTION OF PREFERRED EMBODIMENTS

Figure 1:
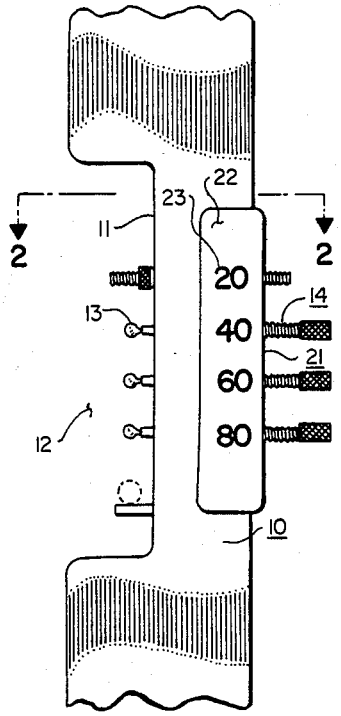
FIG. 1 is a rear elevation of an archery bow at a central portion thereof, illustrating a rear-end view of the sighting screw bracket or mount attached to the bow and accommodating a series of sighting screw units as well as the sight illuminator unit utilized herein.

In FIGS. 1–4 the bow 10 is shown recessed at 11 to provide for a sighting area 12 by which the user of the bow can visualize and see the various sighting tips 13 of the individual sighting screw units 14. Sighting screw units 14 can be anyone of a number of designs or constructions, one of which is shown in the applicant's own patent, U.S. Pat. No. 4,309,827, which is fully incorporated herein by way of reference. Each of the sighting screws 14 thus employ a sighting screw element 15 having a knurled end 16 at one end, a threaded shank 17, and a tapered end portion 18 terminating in sighting bead 19. The tapered portion may be covered with a frusto-conical hollow plastic part 20 which will serve to further delimit and call attention to the sighting bead 19 for sighting purposes. The sighting screw mount 21 may employ a rear flange 22 having range markings 23 as indicated, where desired. Of course, such range markings and indeed the flange itself, may be eliminated if that is the user's choice. In any event, mount 21, in addition to being provided the rear flange 22, where used, also incorporates a central portion 24 provided with screw apertures 25 and 26 accommodating attachment screws 27 and 28 such that the mount can be fixedly attached to the central part of the bow. A dog-leg medial portion 29 joins central portion 24 to attachment portion 30 of the bracket or mount. Attachment portion 30 has a series of slots 31 each of which is toothed on one side 32 and flat, preferably, on the remaining side 33. As to such toothed side, the same may be formed of plastic strip 34 which has a U-configured horizontal cross-section that simply slips over the lip 35 of the mount. In any event, preferably two or three or more slots are provided in the attachment portion 30 of the bracket or mount 21.

In returning to a consideration of each of the sighting screw units 14, it is seen that the sighted screws cooperate with the respective slots 31 in the bracket in the manner shown and is fully described in the aforementioned U.S. Pat. No. 4,309,827. Thus, a round adjustment member 36 is supplied, the same being internally threaded for the accommodation of a sighting screw unit, having knob 37 and also a pinion gear portion 38 which is of lesser diameter than the knob 37 and which engages the toothed rack at 32, for example, in one of the slots. The aforementioned patent fully describes the loosening and tightening of the adjusting screw, its up and down adjustment, and also horizontal adjustment for windage purposes. The particular construction of the sighting screw unit per se forms no part of the invention. It is sufficient to say that suitable washer and nut means or other attachment means at 39 are secured over the threaded shank 15 and at least not threadedly engaging the same so that the adjustment screw may be securely mounted to the bracket at a respective one of the slots 31. Of importance, however, is the inclusion of an illuminator unit 40 seen in FIGS. 2, 5, 6 and also FIGS. 4, 7 and 8, by way of example. In referring to FIGS. 5 and 6 it is seen that the illuminator unit 40 is provided with a housing 41 formed of rear housing half 42 and front housing half 43. The front housing half 43 has a battery cavity 44, and attachment aperture 45, and a positioning pin 46 the latter of which accommodates the pin receptacle 47 of rear housing half 42. In returning to front housing half 43 it is seen that the same likewise includes an illumination recess 48 that is contiguous with a socket aperture 49, suitably contoured as shown to receive light means 50 of the left hand of FIG. 6. An interior recess 51 accommodates conductive ring 52 of the structure shown at the left side of FIG. 6.

Figure 6:
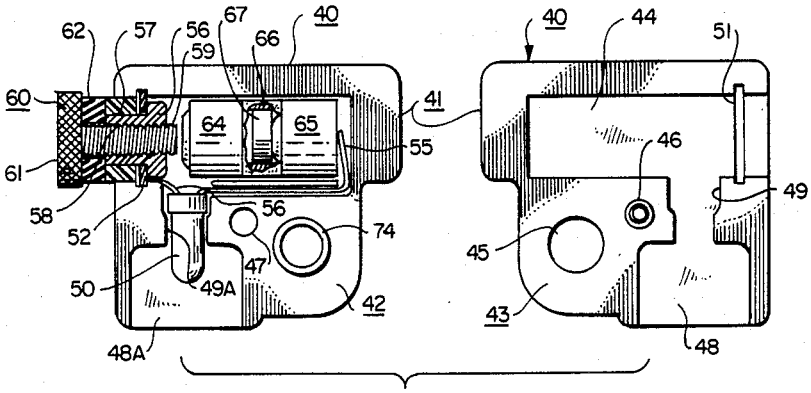
FIG. 6 illustrates the sight illuminator unit as being opened and with the front housing half being laid down such that the housing juncture surface faces upwardly as to both halves of the mount.
Figure 7:
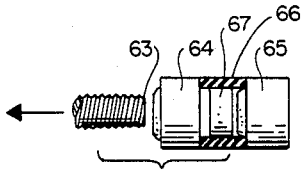
FIG. 7 is an enlarged detail, illustrating the batteries of FIG. 6 at the left hand portion thereof as being non-conductive relationship.
Figure 8:
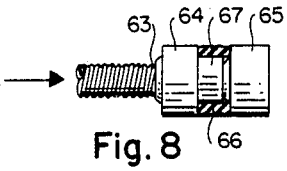
FIG. 8 is similar to FIG. 7 but illustrates that the forward thrusting of the threaded shank of the adjustment screw employed can be used to place the batteries in electrically conductive relationship so as to close the electrical circuit of the illuminator unit.

In considering now the rear housing half, it is seen that the same incorporates an illumination recess 48A complimentary to recess 48 to the right in FIG. 6, and also a socket aperture 49A corresponding to socket aperture 49. Light means 40 preferably is an LED (light emitting diode) having an L-configured conductive strip terminal 55 and also a terminal 56 soldered or otherwise secured to conductive ring 52. The ribbon 55 may be routed through an aperture 56 provided in the left housing half shown in FIG. 6. Additionally, as to the left or rear housing half 42, the same, together with the front housing half 43, are preferably fabricated from plastic and hence are non-conductive. A brass, conductive, flanged sleeve 56, which is internally threaded, is positioned in splined aperture 57 of the rear housing half 42. The same is internally threaded at 58 to accommodate the threaded insertion of adjustment screw shank 59. Screw shank 59 is a portion of adjustment screw 60 having the knurled head 61 as seen in FIG. 6. A rubber or other elastic ring is seen at 66 and will be squeezed together as the adjustment screw is turned down such that the end 63 thereof presses the batteries 64 and 65 together. Such batteries are thus separated by the rubber, noprene or other elastomeric type ring 66, which is resilient. This ring is shown at 66 in the drawings. Of less horizontal (width) dimension than such ring is an electrically conductive element 67 which takes the form, preferably, of a metallic disc or element at 67 and which fits within the ring. Since the ring is of greater width than the disc, then the ring will normally have the batteries 64 and 65 in non-contacting and hence non-conductive relationship with respect to each other, whereby the electrical circuit of the LED or light means 50 will be open. This is the condition shown in FIG. 6. left hand side, and FIG. 7 wherein the tip or end 63 of the adjustment screw is withdrawn from contact with battery 64, or at least where the spring has been withdrawn such that the elasticity of ring 66 is sufficient to urge the batteries 64 and 65 apart. Or, on the other hand, if the adjustment screw is turned down as seen in FIG. 8 so as to thrust the batteries together against the resiliency of the ring 66 and create a compressed condition in such ring, then the batteries are in electrical contact relationship and the circuit closed so that the light means 50 will illuminate. It is noted by the above construction that the electrical circuit, in contrast with other types of lighting means, does not employ a grounded metallic case. Rather, the case itself can be made of insulated plastic, contributing to ease and minimal expense of the manufacturing process.

Figure 2:
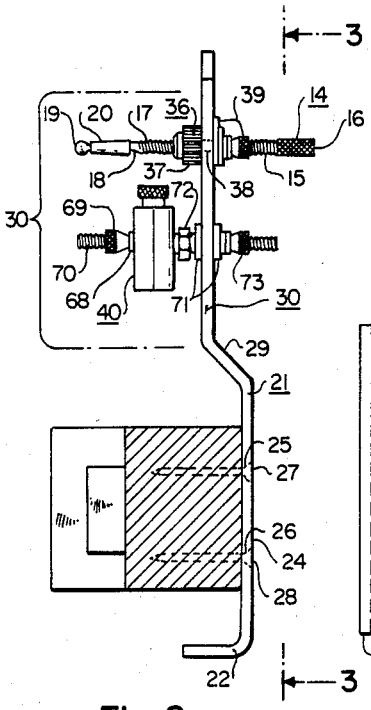
FIG. 2 is a transverse horizontal section taken along the line 2—2 in FIG. 1.
Figure 3:
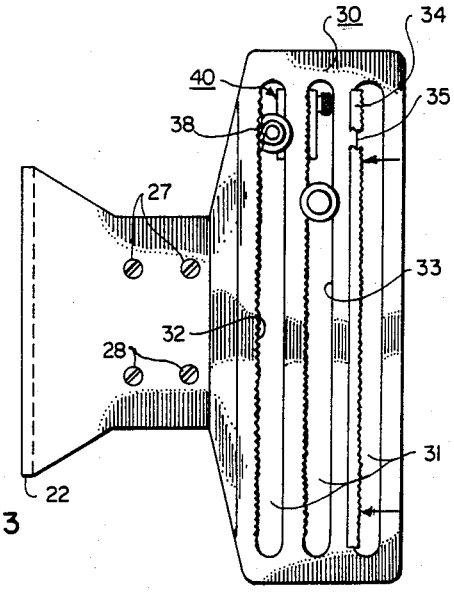
FIG. 3 is an elevation taken along the line 3—3 in FIG. 2, and rotated clockwise 90° the sighting screw units being adjusted as to position and the bow itself being eliminated in the figure for convenience of illustration.
Figure 5:
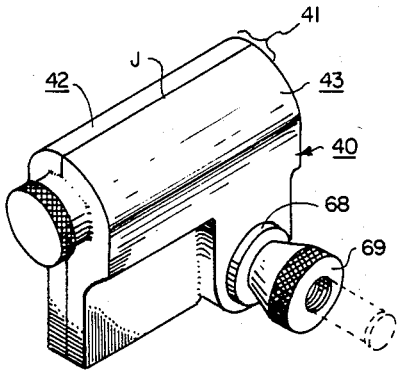
FIG. 5 is an enlarged perspective of the sight illuminator unit employed in the present invention and mounted to the bracket or mount of FIGS. 1–4.
Figure 4:
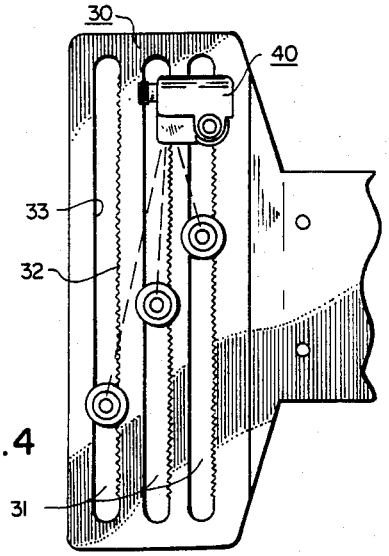
FIG. 4 is similar to FIG. 3 but shows the reverse side of the mount and the several sighting screw units and sight illuminator unit being mounted thereon.

FIG. 5 illustrates the two halves of FIG. 6 being placed together such that the surfaces shown in FIG. 6 come together to a junction J seen in FIG. 5. At this point the washer 68 and nut 69 are employed and securely affix the unit to threaded shank 70 in FIG. 2.

Where desired, the threaded shank 70 may be preliminarily mounted in a chosen position, relative one of the slots 31, by the employment of washers 71 and nuts 72, and nuts 73 as seen in FIG. 2. Additionally, if desired the aperture 74 may be threaded so that, preliminarily, the rear housing unit 42 can be threaded upon the threaded shank 70 prior to the placement of the front housing half over the rear housing half. Note but one sighting screw unit is seen in FIG. 3, and it will be understood that additional sighting units may be employed in the same slot, i.e. the middle slot in FIG. 3, or in any other slot as to all of sighting units employed such as the four seen in FIG. 1.

While the illumination unit can be mounted in any slot, it is preferred that the same be mounted at the upper portion of the rearmost slot, this so that the light coming from the LED will illuminate the rear sections of the tips of the sighting units so that the user may clearly see these tips as illuminated during darkened hours of use such as at dawn or at dusk.

In operation, the user simply implaces the illumination unit 40 in a position desired in a respective one of the slots such that the same can illuminate the tips of the sighting units when the illumination unit is turned on. The latter is accomplished by the user simply turning down on the attachment screw 61 so that the threaded shank of the adjustment screw thrusts the central battery to the right, see FIG. 6, whereby to compress the elastomeric ring at 66 and allow both batteries to come in engagement, on opposite sides, with the electrically conductive disc 67. This causes the illumination of light means 50 to be effected. When the light is to be turned off, the knurled screw is simply backed off so as to allow the resilient forces of the elastomeric ring to expand the ring width such that the batteries no longer form a serial relationship via conductive disc 67, from an electrical standpoint.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. An illuminator unit for illuminating the sight tips of archery bows, said unit including, in combination: housing structure provided with a light aperture; a light mounted proximate and illuminating through said light aperture; an electrical circuit, including battery means, disposed in said housing structure and coupled to said light for selectively energizing the same, said electrical circuit including non-conductive resilient spacer means, compressible along its elemental width to complete said circuit, interposed in said electrical circuit; and actuatable means threadedly engaging said housing structure for selectively compressing said resilient spacer means whereby to electrically complete said circuit.

2. The structure of claim 1 wherein said resilient spacer means comprises an elastomeric, width-wise compressible ring.

3. The structure of claim 1 wherein said housing structure is formed of housing portions made of a plastic, non-conductive material.

4. An illuminator unit for illuminating the sight tips of archery bows, said unit including, in combination: housing structure provided with a light aperture; a light mounted proximate and illuminating through said light aperture; an electrical circuit, including battery means, disposed in said housing structure and coupled to said light for selectively energizing the same, said electrical circuit including non-conductive resilient spacer means interposed in said electrical circuit; and actuatable means for selectively compressing said resilient spacer means whereby to electrically complete said circuit, wherein said resilient spacer means comprises an elastomeric, width-wise compressible ring, and wherein said ring includes an interior conductive element of a width less than that of said ring.

5. The structure of claim 4 wherein said circuit comprises a pair of batteries positioned for series-coupling, said ring with said conductive element being interposed between said batteries.

6. The structure of claim 5 wherein said housing structure is fabricated from non-conductive material and includes a manually adjustable screw as said actuatable means thrustingly engaging a respective one of said batteries, whereby selectively to urge said batteries toward each other, compressing said ring and thereby bringing said batteries in contact with said conductive element.

7. An illuminator unit for the sights of archery bows, said unit comprising: a non-conductive housing having an electrically conductive adjustment screw threaded therein, said housing having an externally shining light and also a battery cavity; an electrically non-conductive elastomeric ring disposed transversely in said cavity, a pair of batteries disposed on opposite sides of said ring and positioned for series-coupling; an electrically-conductive element positioned within said ring and dimensioned to be of less width than said ring, said adjustment screw being positioned to thrust one of said batteries toward the remaining battery, against the compressive resiliency forces of said ring, whereby said batteries selectively make electrical contact through said element; and electrical circuit means completing the circuit to said light through said screw, batteries and element.

8. In combination: an archery bow having a bracket provided with a series of sights; an illuminator unit mounted to said bracket and housing light means for illuminating said sights, said illuminator unit having a non-conductive housing means provided with electrical circuit means, having a non-conductive circuit interruptor, coupled to said light means, and screw means threaded through said housing means for selectively compressing and then releasing the compression as to said interruptor arranged to complete said circuit means when compressed, for thereby completing and also for interrupting said circuit means.

9. The structure of claim 8 wherein said electrical circuit means includes a pair of batteries and an electrically conductive element comprising a disk disposed between said batteries, and a resilient compressible, non-conductive ring surrounding said element, engaging said batteries, and being of greater width than said element, said ring being said interruptor.

* * * * *